US006942354B2

(12) United States Patent
Metayer et al.

(10) Patent No.: US 6,942,354 B2
(45) Date of Patent: Sep. 13, 2005

(54) LIGHTING SYSTEM AND HOUSING THEREFORE

(75) Inventors: Francois Metayer, Charlesbourg (CA); Benoit Laflamme, Quebec (CA)

(73) Assignee: 9090-3493 Quebec Inc., Quebec (CA)

( * ) Notice: Subject to any disclaimer, the term of this patent is extended or adjusted under 35 U.S.C. 154(b) by 25 days.

(21) Appl. No.: 10/393,020

(22) Filed: Mar. 21, 2003

(65) Prior Publication Data

US 2004/0184267 A1 Sep. 23, 2004

(51) Int. Cl.[7] ..... F21V 15/04; F21V 17/04

(52) U.S. Cl. ..... 362/101; 362/147; 362/235; 362/240; 362/288; 362/369; 362/375

(58) Field of Search ..... 362/101, 145–150, 362/226, 227, 232, 235, 236, 238, 240, 249, 250, 267, 288, 306, 362, 364, 365, 368, 369, 375, 390, 394, 395, 399, 400, 800, 310, 329

(56) References Cited

U.S. PATENT DOCUMENTS

| | | | | | |
|---|---|---|---|---|---|
| 2,257,038 | A | * | 9/1941 | Crossley | 362/364 |
| 3,196,266 | A | * | 7/1965 | Grosser | 362/368 |
| 4,056,718 | A | * | 11/1977 | Faux et al. | 362/306 |
| 4,967,328 | A | * | 10/1990 | Tatavoosian | 362/267 |
| 5,045,978 | A | * | 9/1991 | Gargle | 362/267 |
| 5,101,326 | A | * | 3/1992 | Roney | 362/249 |
| 5,289,358 | A | * | 2/1994 | Halemeier | 362/365 |
| 5,633,629 | A | | 5/1997 | Hochstein | 340/907 |
| 5,800,041 | A | * | 9/1998 | Poggi | 362/267 |
| 5,800,045 | A | * | 9/1998 | Kish et al. | 362/306 |
| 5,896,093 | A | * | 4/1999 | Sjobom | 362/244 |
| 5,924,784 | A | | 7/1999 | Chliwnyj et al. | 362/234 |
| 6,016,038 | A | | 1/2000 | Mueller et al. | 315/291 |
| 6,039,459 | A | * | 3/2000 | Chang | 362/253 |
| 6,150,774 | A | | 11/2000 | Mueller et al. | 315/291 |
| 6,184,628 | B1 | * | 2/2001 | Ruthenberg | 362/362 |
| 6,200,000 | B1 | * | 3/2001 | Burnidge | 362/249 |
| 6,211,626 | B1 | | 4/2001 | Lys et al. | 315/291 |
| 6,247,827 | B1 | * | 6/2001 | Carter | 362/101 |
| 6,292,901 | B1 | | 9/2001 | Lys et al. | 713/300 |
| 6,340,868 | B1 | | 1/2002 | Lys et al. | 315/185 S |
| 6,351,079 | B1 | | 2/2002 | Willis | 315/200 A |
| 6,357,902 | B1 | * | 3/2002 | Horowitz | 362/240 |
| 6,435,691 | B1 | * | 8/2002 | Macey et al. | 362/147 |
| 6,539,561 | B2 | * | 4/2003 | Shimizu | 362/101 |
| 6,561,690 | B2 | * | 5/2003 | Balestriero et al. | 362/240 |
| 6,603,276 | B2 | | 8/2003 | Chansky et al. | 315/362 |
| 6,611,244 | B1 | | 8/2003 | Guritz | 345/46 |
| 6,636,003 | B2 | | 10/2003 | Rahm et al. | 315/179 |
| 6,744,223 | B2 | | 6/2004 | Laflamme et al. | 315/291 |
| 2003/0048632 | A1 | * | 3/2003 | Archer | 362/101 |

* cited by examiner

*Primary Examiner*—Alan Cariaso

(57) ABSTRACT

A lighting system is provided including an illumination member, a housing and a resilient element. The illumination member has an electricity conductive portion and a light-emitting portion. The housing defines a chamber for receiving therein the illumination member and includes a socket portion adapted for engaging the electricity conductive portion of the illumination member. The resilient element establishes a contact between the illumination member and the housing for biasing the electricity conductive portion against the socket portion. In a variant, the housing has a light receiving portion defining the chamber and a passageway to the chamber. The housing includes a cap adapted to be removably connected to the light receiving portion for sealing the passageway. In this variant, the illumination member includes a handle portion enabling the removal of the illumination member from the chamber through the passageway.

50 Claims, 13 Drawing Sheets

LIGHTING SYSTEM AND HOUSING THEREFORE

FIELD OF THE INVENTION

The present invention relates to lighting systems and, more specifically to lighting systems having a housing and an illumination member.

BACKGROUND OF THE INVENTION

LEDs are known and, when placed on an electrical circuit, accept electrical impulses from the circuit and convert the impulses into light signals. LEDs are energy efficient, they give off virtually no heat, and they have a long lifetime. Typically, the illumination modules make use of a microprocessor to control which LED emits and at what intensity. The LED illumination module is positioned within a housing having electrical connectors for providing electrical power to the illumination module.

A deficiency with existing LED illumination modules is that they are typically heavier than incandescent light bulbs. This results in the LED illumination modules being easily displaced within the housing causing electrical connections to be breached. This makes the system unreliable and unpleasant to operate.

In the context of the above, there is a need in the industry to provide a lighting system and associated housing that alleviates at least in part problems associated with the prior art.

SUMMARY OF THE INVENTION

In accordance with a first broad aspect, the invention provides a lighting system having an illumination member, a housing and a resilient element. The illumination member includes an electricity conductive portion and a light emitting portion. The housing defines a chamber for receiving therein the illumination member and includes a socket portion adapted for engaging the electricity conductive portion of the illumination member. The resilient element is suitable for establishing a contact between the illumination member and the housing for biasing the electricity conductive portion against the socket portion.

In a first specific example of implementation, the resilient element protrudes from the light-emitting portion of the illumination member.

In a second specific example of implementation, the housing has an outer surface and an inner surface and the resilient element protrudes from the inner surface of the housing.

In a specific non-limiting implementation, the resilient element includes a spring.

In a specific implementation, the housing includes a protective cover portion that is releasably connected to the remaining portion of the housing.

In accordance with a variant, the illumination member includes a handle portion enabling removal of the illumination member from the housing. In a non-limiting implementation, the resilient element is adapted to engage the handle portion.

In accordance with another broad aspect, the invention provides an illumination device suitable for use in a lighting system including a housing having a socket portion. The illumination device includes an electricity conductive portion adapted for engaging the socket portion of the housing.

The illumination device also includes a light emitting portion and a resilient element suitable for establishing a contact with the housing of the lighting system. The resilient element is adapted for biasing the electricity conductive portion against the socket portion of the housing.

In a specific implementation, the illumination device includes a plurality of light emitting diodes (LEDs).

In accordance with another broad aspect, the invention provides a housing suitable for use in a lighting system. The housing includes a light receiving portion defining a chamber for receiving an illumination member therein, the illumination member having an electricity conductive portion. The housing also includes a socket portion adapted for engaging the electricity conductive portion of the illumination member. The housing also includes a resilient element suitable for establishing a contact between the illumination member positioned within the housing and the housing, for biasing the electricity conductive portion of the illumination member against the socket portion.

In a specific implementation, the housing includes a protective cover portion and a receptacle portion, the receptacle portion is releasably connected to the protective cover portion of the housing. The protective cover portion has an outer surface and an inner surface, and the resilient element protrudes from the inner surface. The resilient element may be releasably connected to the inner surface or permanently affixed thereto. In a non-limiting implementation, the protective cover portion includes a removable cap.

In accordance with another broad aspect, the invention provides a lighting system including an illumination member and a housing. The illumination member includes a handle portion and a light emitting portion. The housing includes a light receiving portion defining a chamber for receiving the illumination member therein and a passageway to the chamber. The housing also includes a cap adapted for being removably connected to the light receiving portion for sealing the passageway. The handle portion of the illumination member enables removal of the illumination member from the chamber through the passageway.

In a specific implementation, the handle portion protrudes from the light emitting portion. The housing is adapted for being positioned within a wall such that the cap can be accessed from the surface of the wall.

In a non-limiting implementation, the wall is part of a spa unit.

These and other aspects and features of the present invention will now become apparent to those of ordinary skill in the art upon review of the following description of specific embodiments of the invention in conjunction with the accompanying drawings.

Other aspects and features of the present invention will become apparent to those ordinarily skilled in the art upon review of the following description of specific embodiments of the invention in conjunction with the accompanying figures.

DETAILED DESCRIPTION

A specific example of implementation of the present invention will be described with reference to the drawings, like numerals being used for like and corresponding parts of the various drawings.

With reference to FIGS. 1–5 of the drawings, there is shown a lighting system 100, as well as its various components, in accordance with a specific example of implementation of the invention.

Figure 1A:
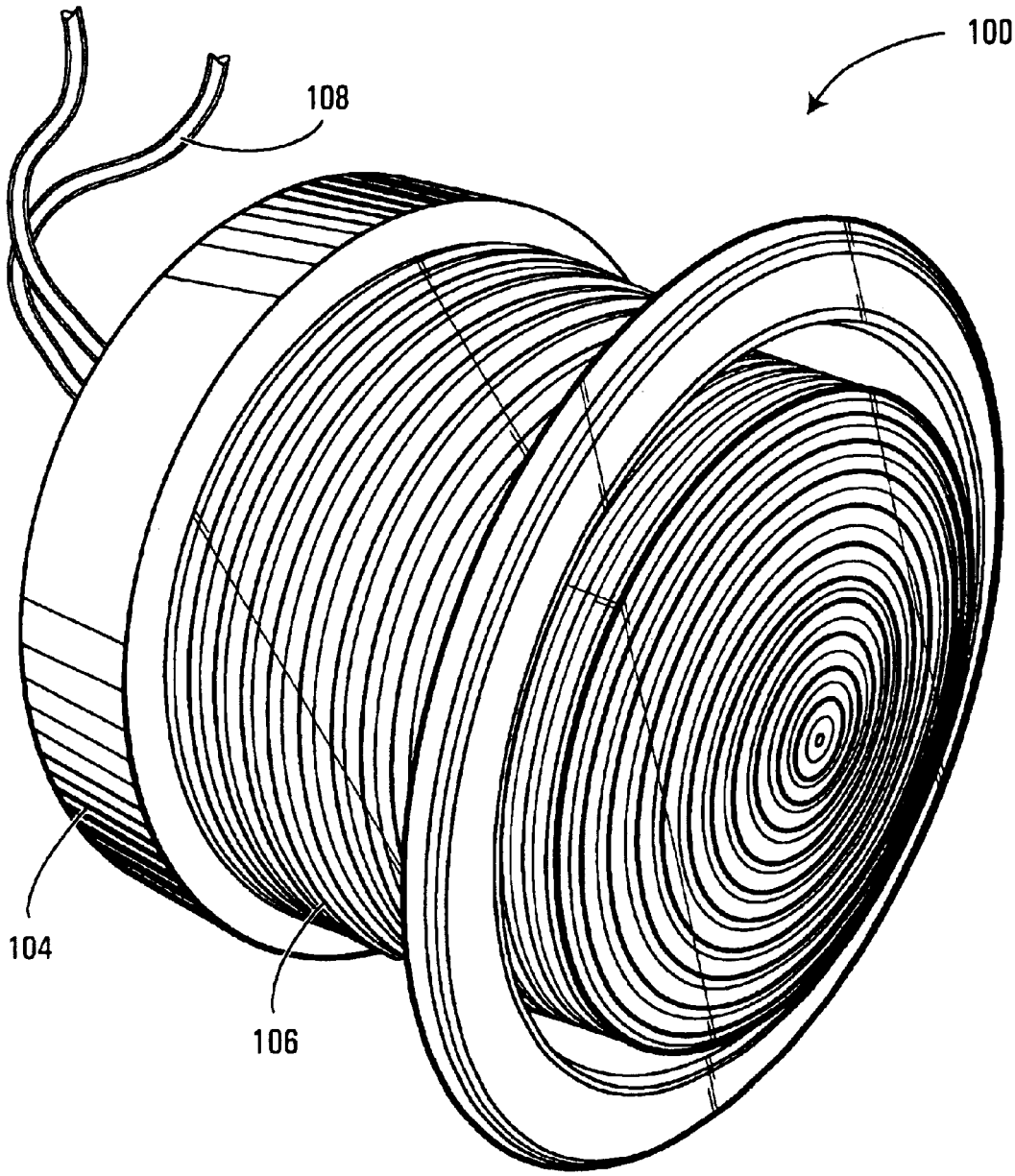
FIGS. 1*a* and 1*b* show two different perspective views of a lighting system in accordance with a specific example of implementation of the invention.
Figure 1B:
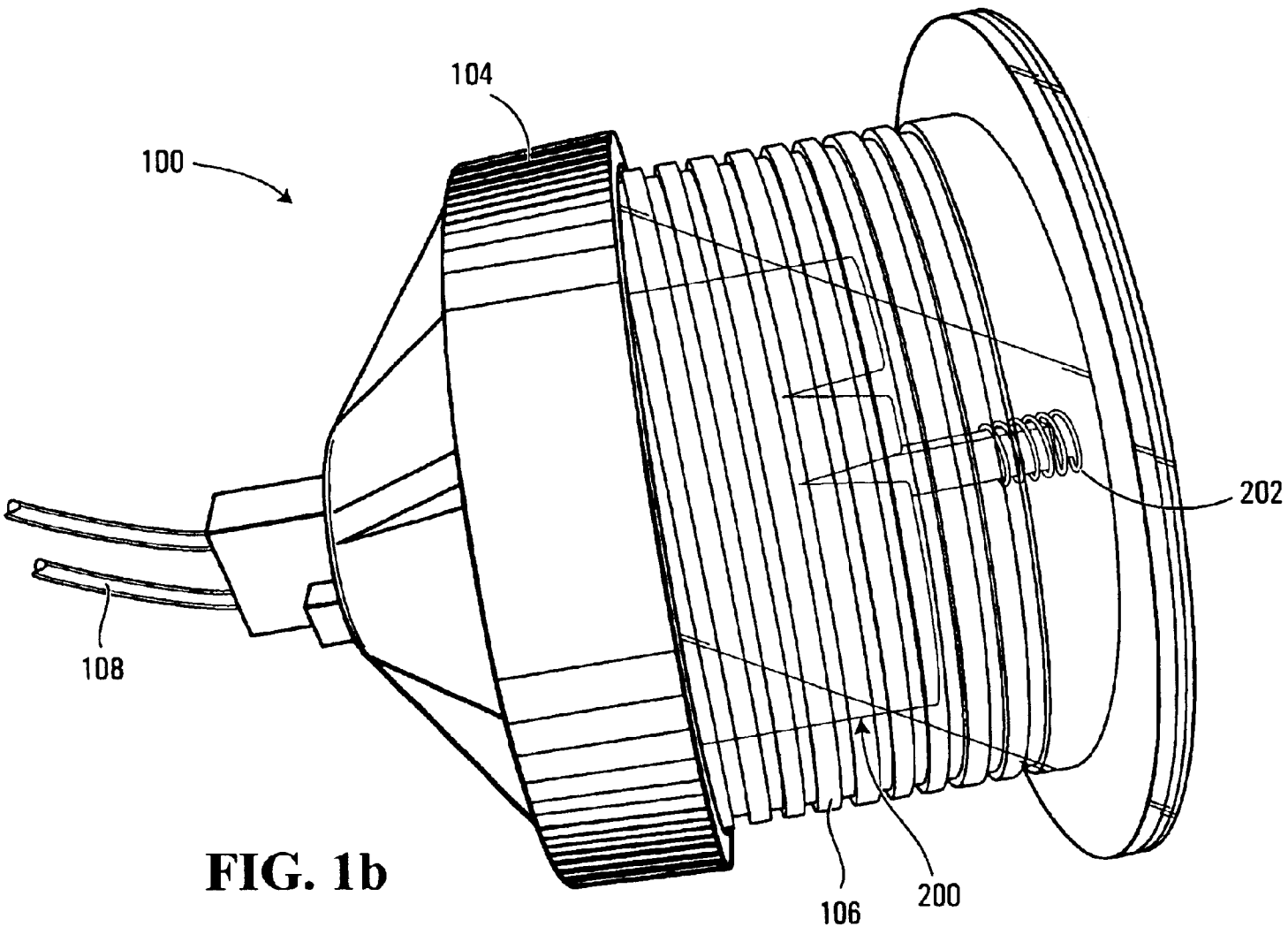
Figure 2:
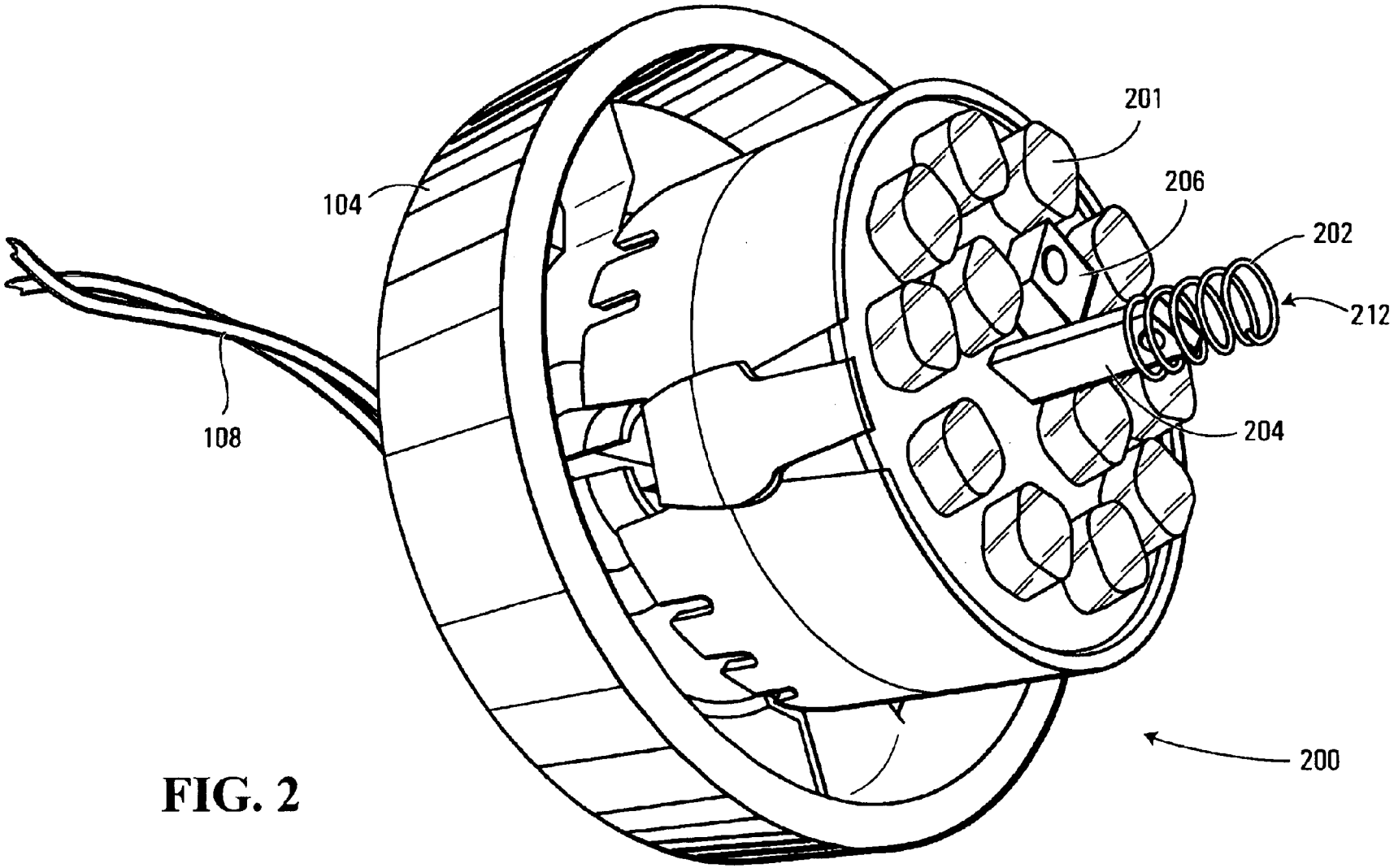
FIG. 2 shows a perspective view of the lighting system of FIG. 1 without the protective cover portion of the housing, in accordance with a specific example of implementation of the invention.

As shown in FIGS. 1*a* and 1*b*, the lighting system 100 includes a housing made up of a receptacle portion 104 and a protective cover portion 106. In addition, as shown in FIG. 2, the lighting system 100 further includes an illumination member 200, and a resilient element 202. The combination of the protective cover portion 106 and the receptacle portion 104 of the housing defines a chamber for receiving the illumination member 200. FIG. 1*b* shows the protective cover portion 106, the receptacle portion 104, the illumination member 200 and the resilient member 202 shown in an assembled state.

Figure 4:
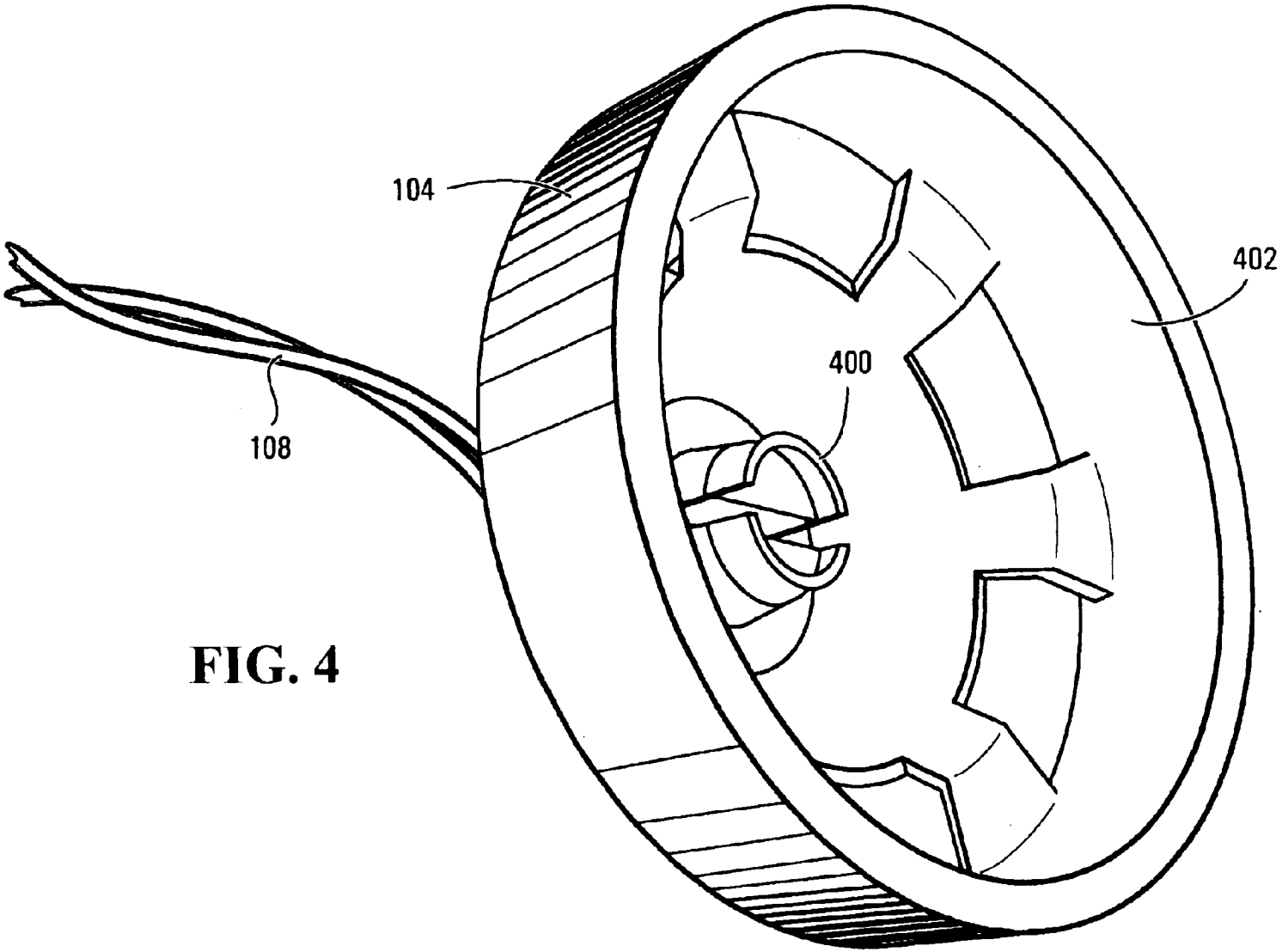
FIG. 4 shows a perspective view of a receptacle portion of the housing suitable for use with the lighting system of FIG. 1 in accordance with a specific example of implementation of the invention.
Figure 5A:
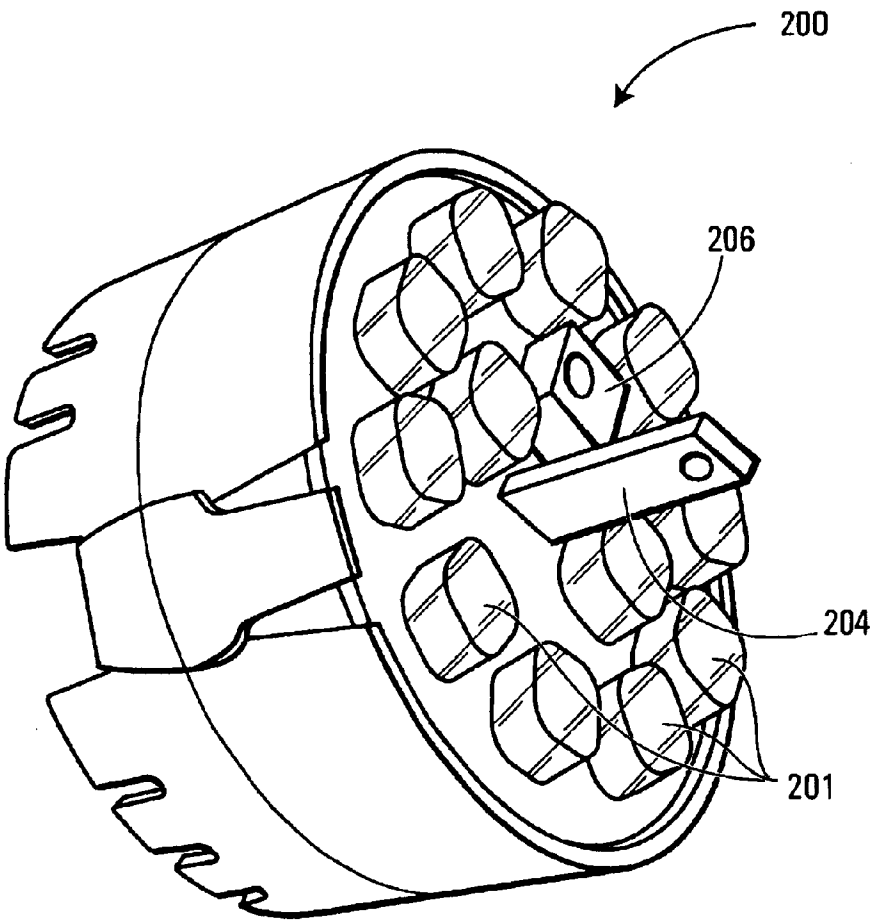
FIGS. 5*a* and 5*b* show front and rear perspective views of an illumination member suitable for use with the lighting system of FIG. 1 in accordance with a specific example of implementation of the invention.
Figure 5B:
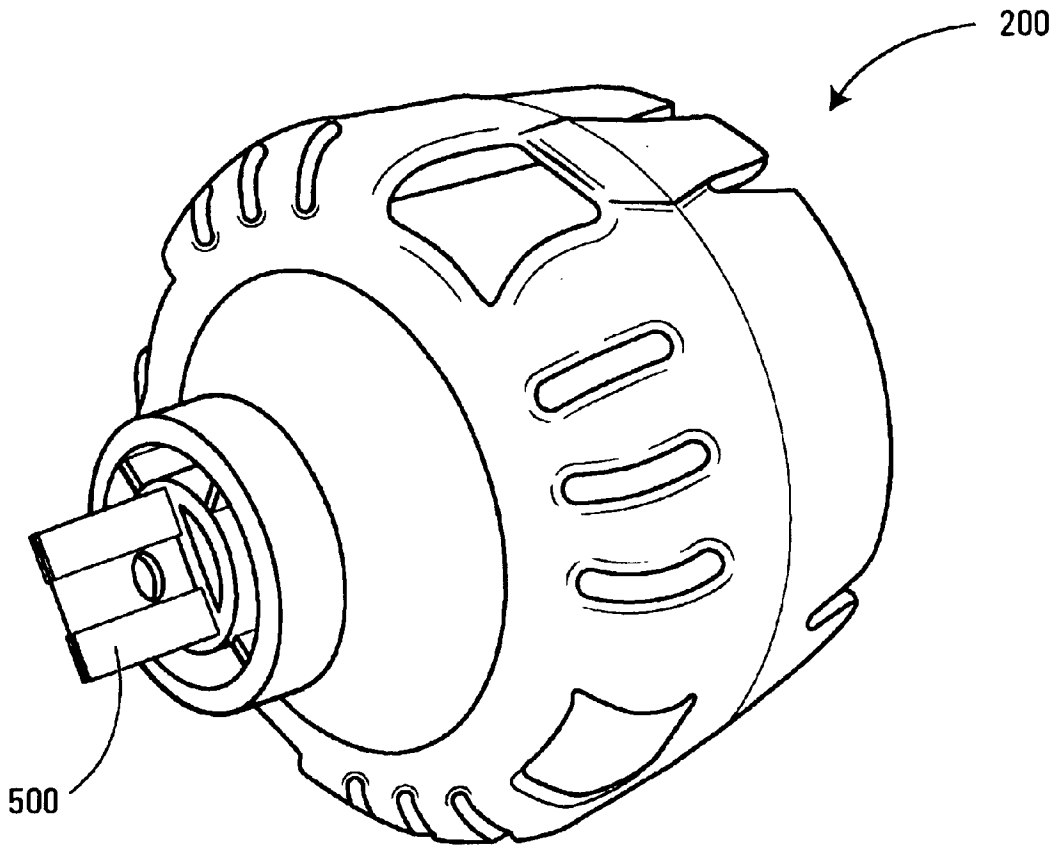

The illumination member 200 includes a light emitting portion, which in the specific embodiment shown in FIG. 2, includes light emitting diodes 201, and an electricity conductive portion 500 (shown in FIG. 5*b*). As shown in FIG. 4, the receptacle portion 104 of the housing includes a socket portion 400. The socket portion 400 of the housing is adapted for engaging the electricity conductive portion 500 of the illumination member 200, as shown in FIG. 2. As such, when the illumination member 200 is positioned within the housing, as shown in FIGS. 1*a* and 1*b*, the resilient element 202 is suitable for establishing a contact between the illumination member 200 and the housing for biasing the electricity conductive portion 500 against the socket portion 400 of the receptacle portion 104.

In a specific implementation, the receptacle portion 104 and the protective cover portion 106 are detachable from one another such as to allow a person to access an illumination member 200 contained therein. Such access may be desirable to allow the user to replace the illumination member 200 located within the chamber when the illumination member 200 is no longer operational, for example. Alternatively, when access to the chamber is not desirable, the receptacle portion 104 and the protective cover portion 106 may be formed integrally, or may be fastened to one another in a manner wherein they are unable to be detached during ordinary use of lighting system 100.

As mentioned above, the receptacle portion 104 of the housing, shown in isolated form in FIG. 4, includes an socket portion 400. The socket portion 400 is adapted for providing an electrical connection between electrical wire 108 and illumination member 200. The socket portion 400 is adapted to engage the electricity conductive portion 500 (shown in FIG. 5*b*) of illumination member 200. The receptacle portion 104 also includes a flange member 402 around the socket portion 400. The flange member 402 is adapted for coupling the receptacle portion 104 to the protective cover portion 106. Although not shown in the drawings, in an alternative embodiment, the flange member 402 includes coupling elements adapted to connect with corresponding coupling elements located on the protective cover portion 106. In a non-limiting implementation, the flange member 402 includes threads that are adapted to matingly engage corresponding grooves on the protective cover portion 106.

It will be appreciated by the person skilled in the art that the shape of the protective cover portion 106 and the flange member 402 may differ widely between embodiments.

Figure 3A:
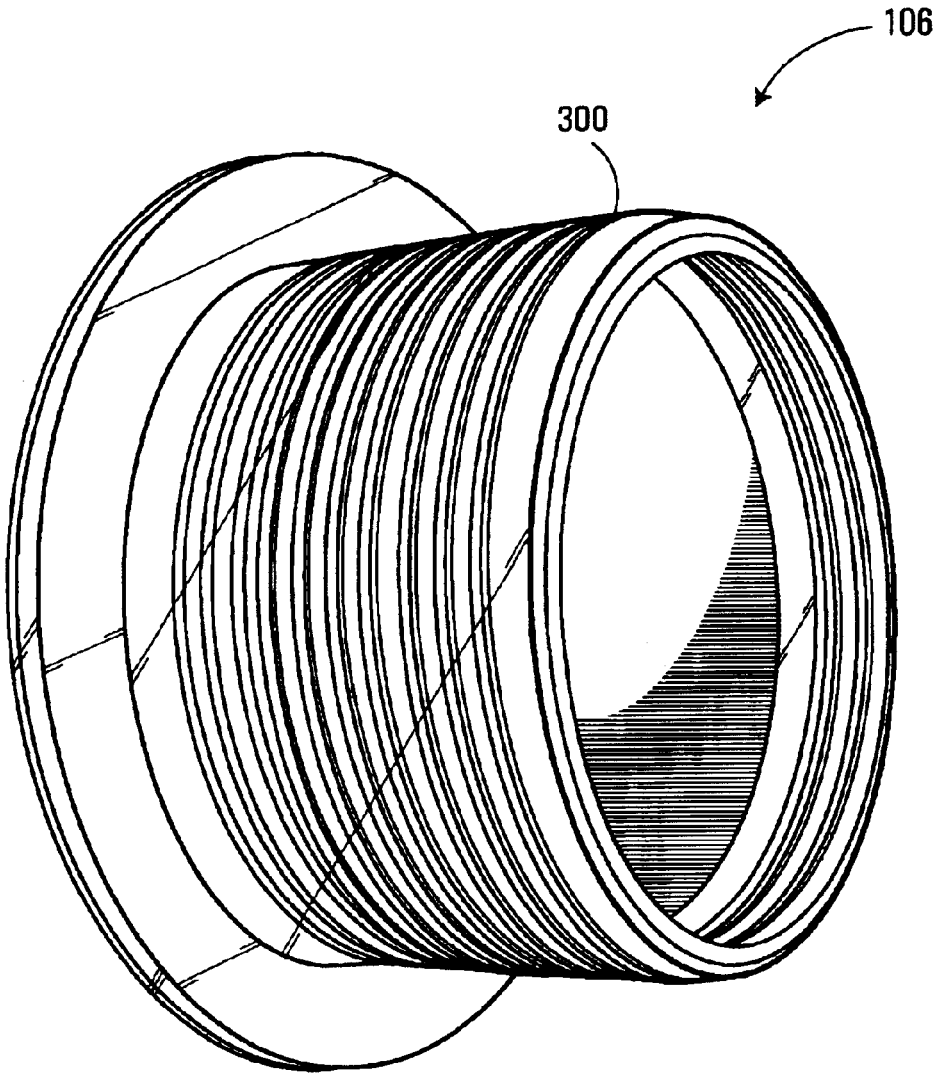
FIG. 3*a* shows a perspective view of a protective cover portion of the housing suitable for use with the lighting system of FIG. 1, in accordance with a specific example of implementation of the invention.
Figure 3B:
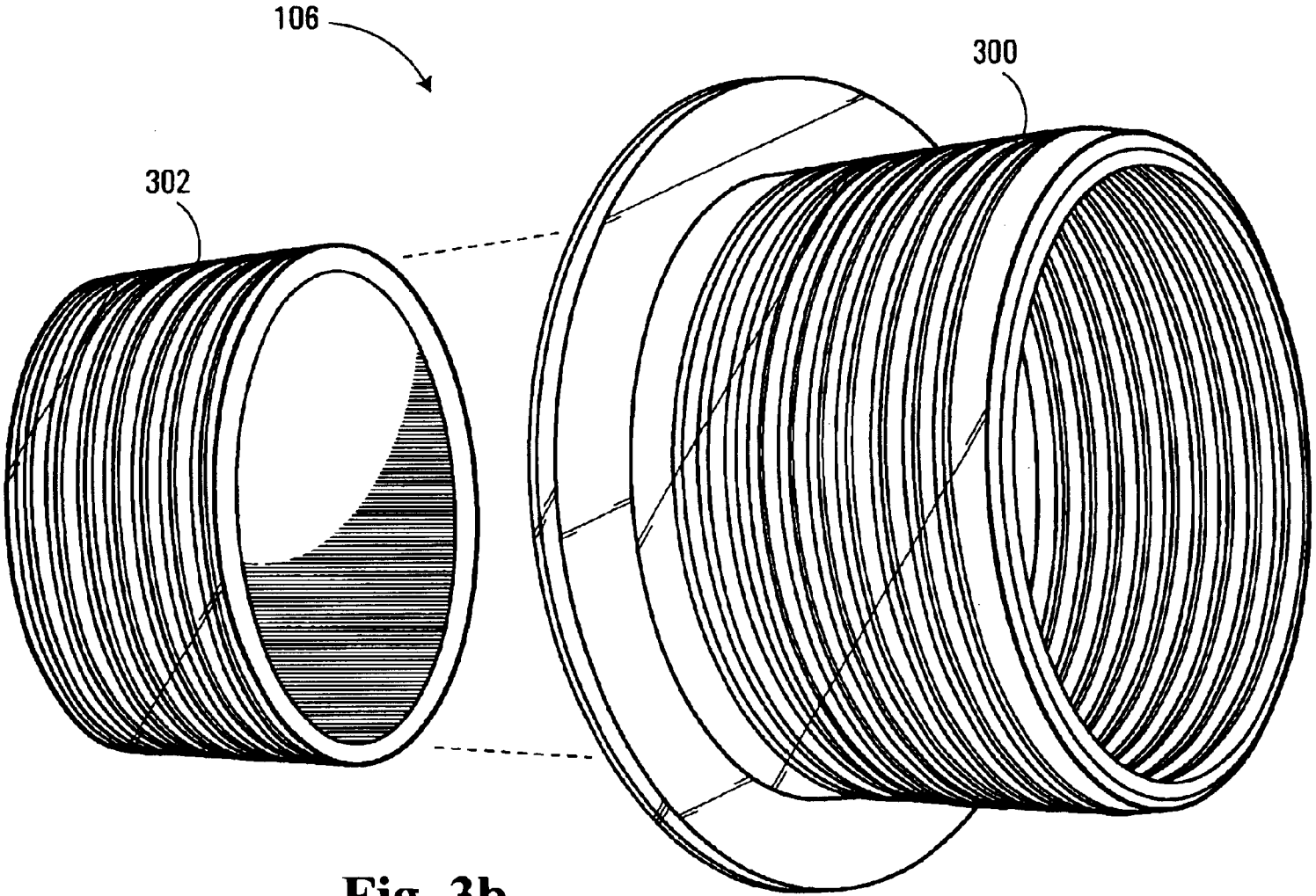
FIG. 3*b* shows an exploded view of a protective cover portion of the housing and a removable cap, suitable for use with the lighting system of FIG. 1 in accordance with a specific example of implementation of the invention.

The protective cover portion 106 is shown in isolated form in FIGS. 3*a* and 3*b*. In accordance with the specific embodiment shown, the protective cover portion 106 includes an elongated body 300. The elongated body 300 may be made of a substantially translucent material or of an opaque material.

As shown in FIG. 3*b*, the protective cover portion 106 includes a cap 302 that is adapted to seal the end of the elongated body 300 opposite from the end of the elongated body 300 that is adapted to be connected to the receptacle portion 104 of the housing. The cap 302 is preferably made of a substantially translucent material such as to allow light emitted by an illumination member 200 located within the chamber defined by the housing to be visible outside of the housing. In a specific implementation, the elongated body 300 and the cap 302 are made of substantially the same material.

As mentioned above, the protective cover portion 106 and the receptacle portion 104 define a chamber for receiving the illumination member 200. In a non-limiting implementation, shown in FIGS. 3*a*, 3*b* and 3*c*, the cap 302 is removable from the protective cover portion 106. As such, the opening at the end of the elongated body 300 that is opposite from the end of elongated body 300 that is adapted to connect to the receptacle portion 104 of the housing defines a passageway to the chamber that is adapted to be sealed by cap 302. In the example shown in FIGS. 3*a* and 3*b*, the cap includes threads for engaging corresponding grooves on the interior surface of elongated body 300.

Although the specific implementation shown in the Figures illustrates that elongated body 300 is part of the protective cover portion 106, in an alternate implementation, the elongated body 300 can be part of the receptacle portion 104. In such an implementation, only cap 302 would be removable from the remaining portion of the housing.

As mentioned above, the illumination member 200, shown in isolated form in FIGS. 5*a* and 5*b* of the drawings, includes an electricity conductive portion 500 and a body having a light emitting portion. In a specific implementation shown in the Figures, the light emitting portion includes a plurality of light emitting diodes (LEDs) 201 electrically connected to electricity conductive portion 500.

In accordance with a variant, the illumination member 200 includes a plurality of light emitting diodes (LEDs) and a micro-controller module. The micro-controller module is contained within the body of illumination member 200 and is electrically connected to electricity conductive portion 500. Optionally, illumination member 200 also includes an infra-red sensor 206 operatively coupled to the micro-controller module such as to provide the micro-controller module with control signals. The micro-controller module is programmed to selectively supply an electrical signal to a subset of the plurality of LEDs. The specific functions performed by the micro-controller and the manner in which these functions are implemented is not necessary for the understanding of the present invention and as such will not be described further here. The reader is invited to refer to co-pending patent application Ser. No. 10/283,948 filed Oct. 30, 2002 by Laflamme et al. for an example of specific functions implemented by the micro-controller. The content of this document is incorporated herein by reference.

Figure 5C:
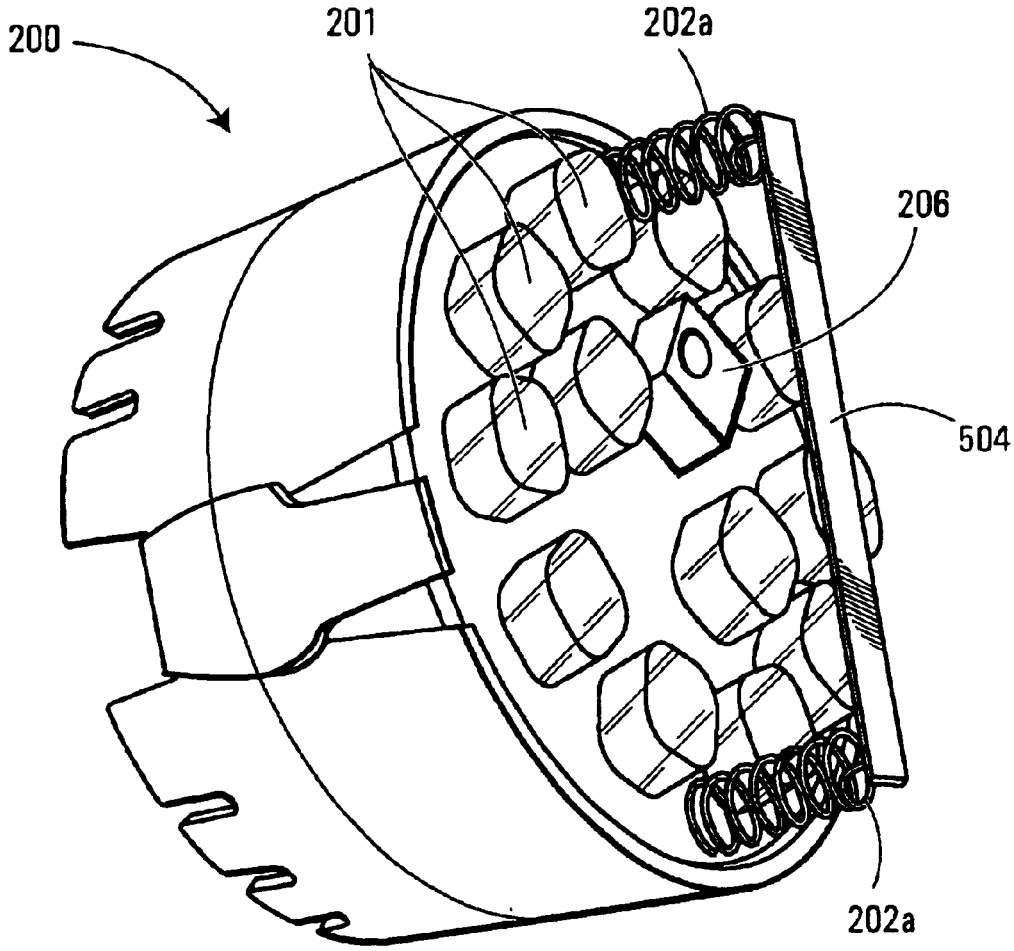
FIGS. 5*c*, 5*d* and 5*e* show front perspective views of an illumination member including various embodiments of a resilient element and handle suitable for use with the lighting system of FIG. 1 in accordance with examples of implementation of the invention.

As shown in FIGS. 5*a*, 5*c*, 5*d* and 5*e*, in accordance with a specific embodiment, the illumination member 200 includes a handle portion 204 (504 in FIG. 5*c*). The handle portion enables the manipulation of the illumination member 200 for positioning the illumination member 200 within the chamber defined by the housing. The handle portion also enables the manipulation of the illumination member 200 for removal of the illumination member 200 from the chamber.

Figure 5D:
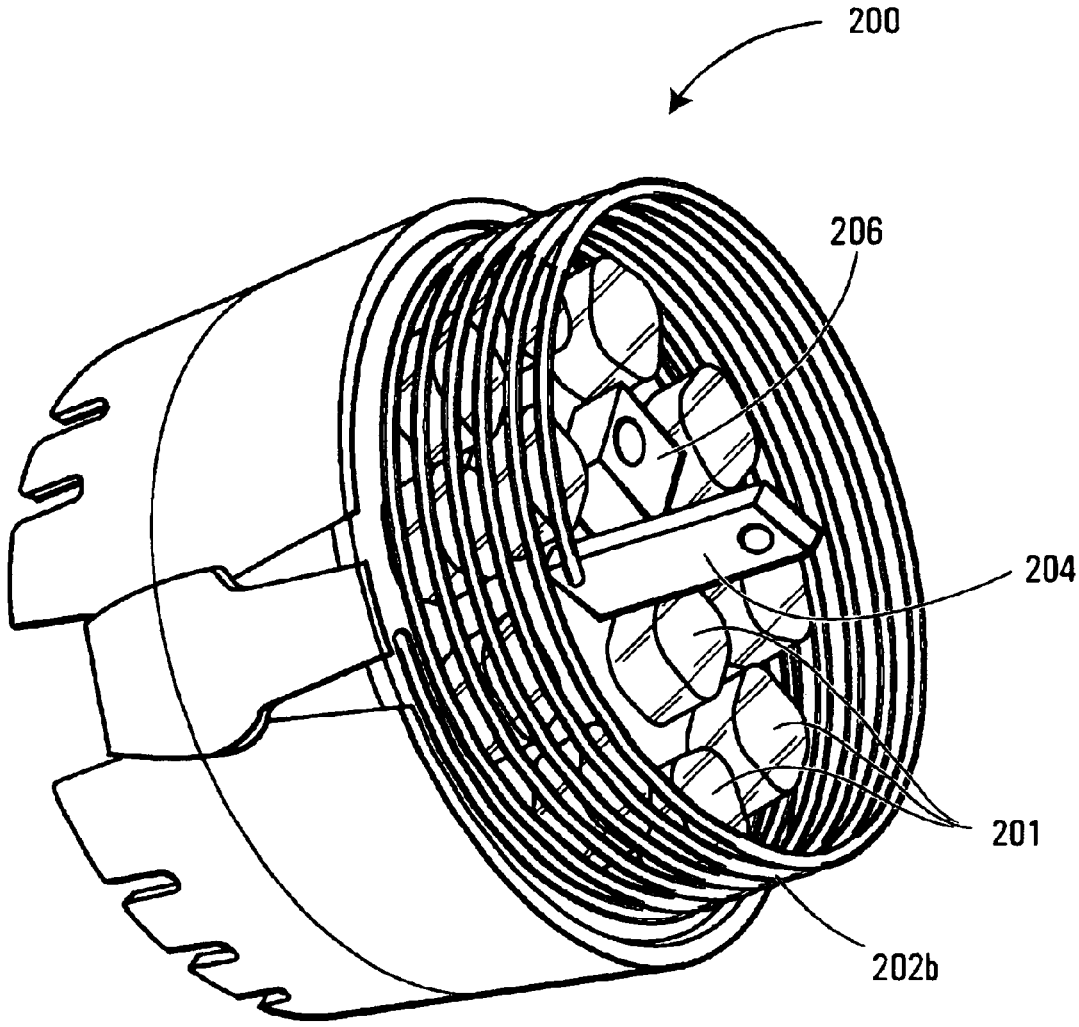
Figure 5E:
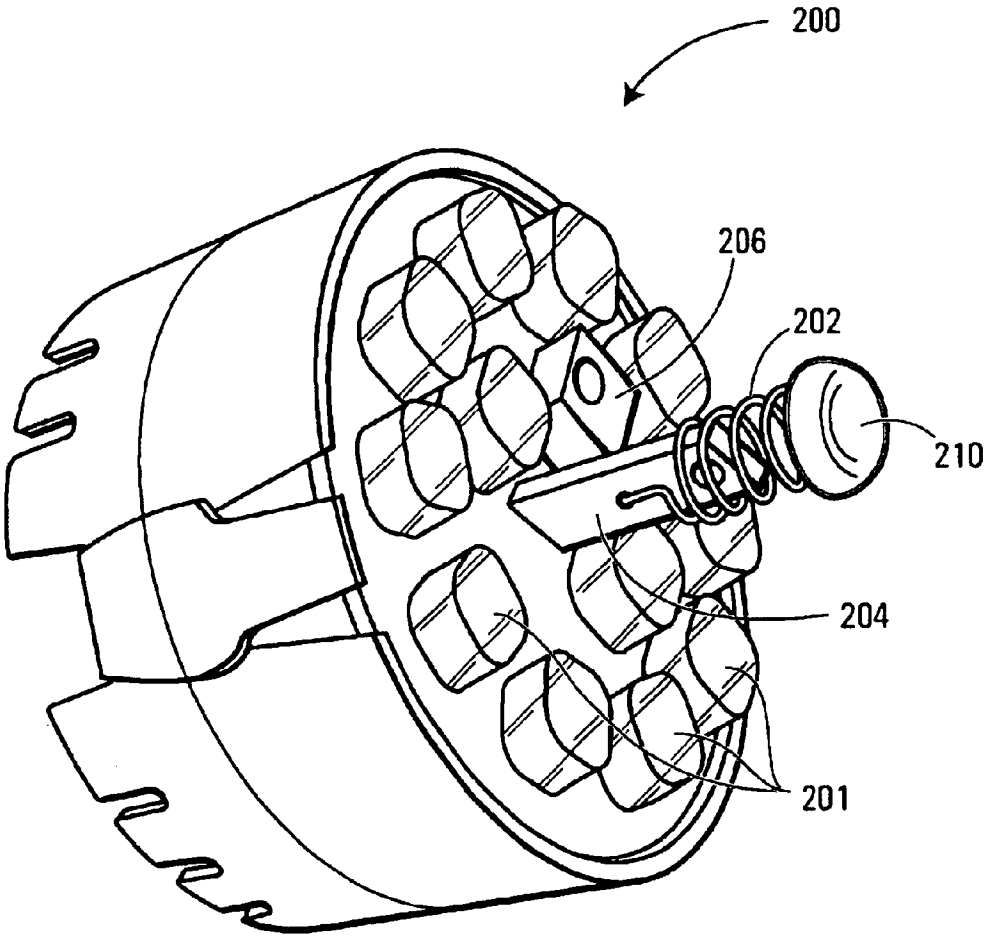

FIGS. 5*a*, 5*d* and 5*e* show an illumination member 200 including a handle portion 204 in accordance with a first non-limiting example wherein the handle portion protrudes substantially centrally from the light-emitting portion. In this implementation, the handle portion 204 is permanently affixed to the illumination member 200. The handle portion 204 may be made using any suitable material. In a very specific implementation, the handle portion is made from a piece of printed circuit board (PC board). The use of a piece of PC board allows for a low cost implementation of the handle.

FIG. 5*c* shows an illumination member 200 including a handle portion 504 in accordance with a second non-limiting example. In this implementation, the handle portion 504 protrudes from the illumination member 200 above the light-emitting portion. The handle portion 504 is in the form of an elongated strip of material positioned over the light emitting portion, and is connected to the illumination member 200 through resilient members. In the embodiment shown, two resilient members are used to connect the handle portion 504 to illumination member 200, however more or less than two resilient members may also be used. Alternatively, the handle portion 504 may be connected on two or more points on the illumination member 200 through non-resilient members. The handle portion 504 may be made of any suitable material. In a non-limiting implementation, the handle portion 504 is made of a translucent material.

As mentioned above, the resilient element 202 is suitable for establishing contact between the illumination member 200 and the housing, for biasing the electricity conductive portion 500 of the illumination member 200 against the socket portion 400 of the housing. The resilient element 202 is positioned such that, when the protective cover portion 106 is connected to the receptacle portion 104 and when the illumination member 200 is within the housing, the resilient element 202 applies a force on the illumination member 200 toward the socket portion 400 of receptacle portion 104. This causes the electricity conductive portion 500 of illumination member 200 to be biased toward socket member 400.

The resilient element 202 may be any suitable compressible structure that is adapted to substantially retake its shape. In the specific embodiments shown in the Figures, the resilient element 202 is a spring, however any other suitable resilient elements can be used without departing from the spirit of the invention. For example, other, non-limiting examples of a resilient member might include a neoprene structure, PORON™ or a rubber structure.

Optionally, in order to prevent the resilient member 202 from sliding out of place, the resilient element 202 may include a rubber exterior surface 212 for increasing its frictional engagement with the protective cover portion 106 of the housing. Alternatively, the resilient element 202 may include a rubber element 210 shown in FIG. 5*e* positioned on the end of the resilient element 202 opposite the light emitting portion. The rubber element 210 also increases the frictional engagement between the resilient member and the protective cover portion 106.

In a first specific example of implementation, as shown in FIGS. 5*c*–5*e*, the resilient element 202 protrudes from the light-emitting portion 200. The resilient element 202 can be releasably connected to the light emitting portion or permanently affixed thereto.

In FIGS. 2 and 5*e*, the resilient element 202 is shown positioned substantially centrally to the light emitting portion and mounted on top of handle portion 204. In an alternate embodiment (not shown in the figures), the resilient element 202 may be mounted on light emitting portion 200.

In FIG. 5*c*, the resilient element 202*a* is shown positioned on the light emitting portion and includes multiple resilient sub-elements, in this case two springs. Additional resilient sub-elements may be provided without detracting from the spirit of the invention.

In FIG. 5*d*, the resilient element 202*b* is shown positioned substantially about the periphery of the light emitting portion.

Figure 3C:
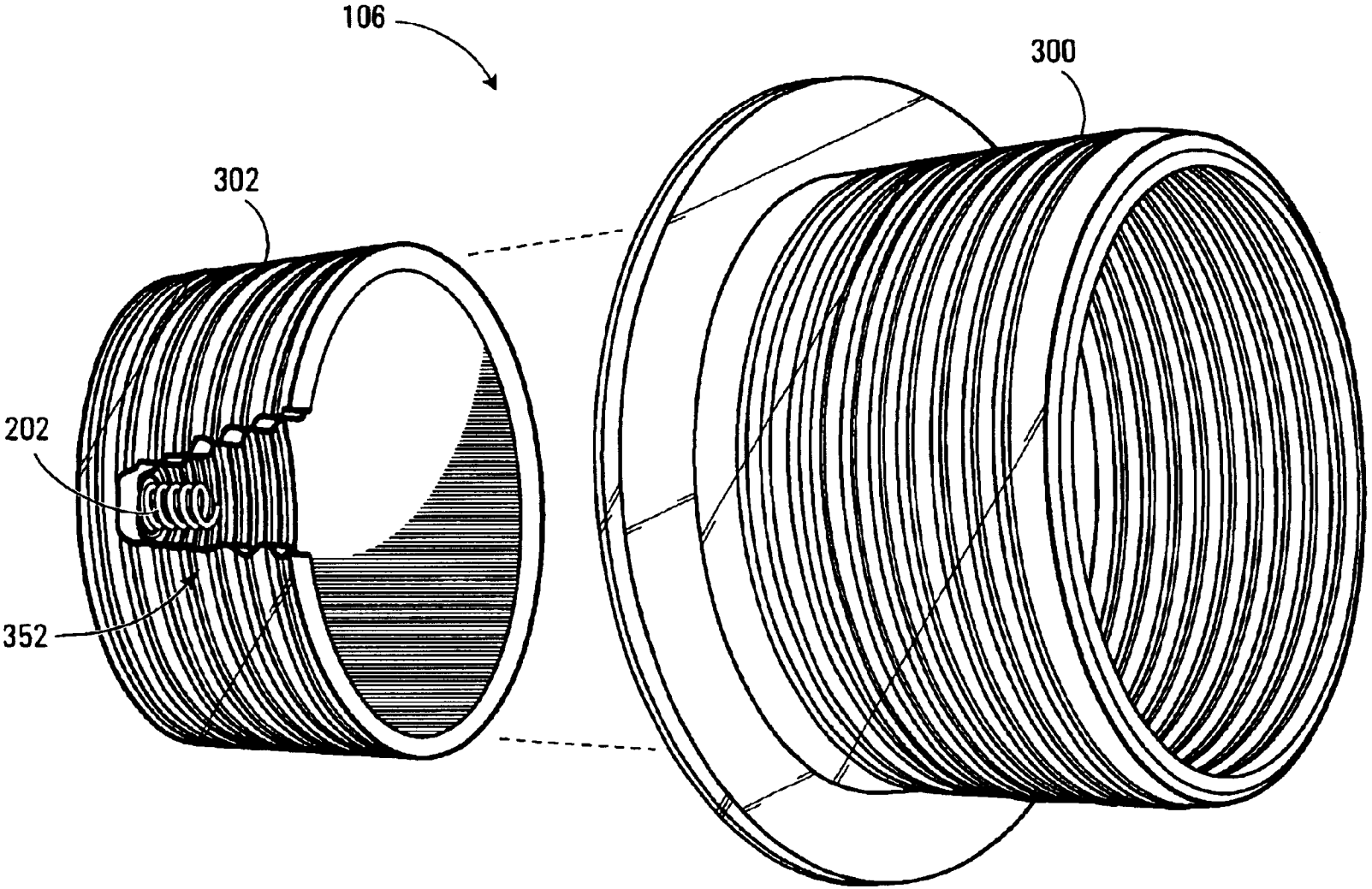
FIG. 3*c* shows an exploded view of a protective cover portion of the housing and a a removable cap, suitable for use with the lighting system of FIG. 1 in accordance with an alternative specific example of implementation of the invention.

In a second specific example of implementation, the resilient element 202 protrudes from the inner surface of the housing. An example of such an embodiment is shown in FIG. 3*c* of the drawings. In FIG. 3*c*, the resilient element 202 is included as part of the protective cover portion 106 and protrudes from the inner surface of the cap 302. In order to facilitate understanding, a portion of the cap 302 has been cut-away around area 352 such that the resilient element 202 can be seen coupled to cap 302. It should be understood that in the case where protective cover portion 106 does not include a removable cap 302, the resilient element 202 can be part of the protective cover portion 106, itself. The resilient element 202 can be releasably connected to the inner surface of the housing or permanently affixed thereto. In the configuration shown in FIG. 3*c*, the resilient element 202 is adapted to engage the illumination member 200 or an element protruding from the illumination member 200. In a non-limiting example, the element protruding from the illumination member 200 is a handle portion and the resilient element 202 is adapted to engage the handle portion.

Figure 6:
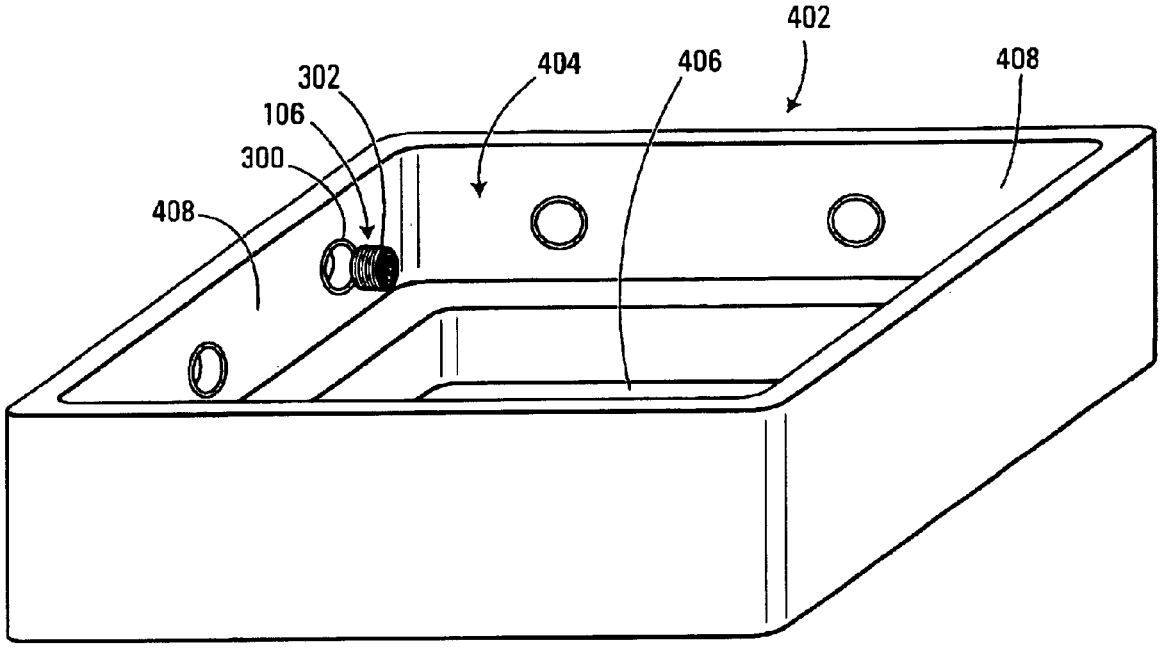
FIG. 6 is a perspective view of spa unit including the lighting system of FIG. 1.

As shown in FIG. 6, in a specific implementation, the lighting system 100 is adapted for being installed within a wall 408 of a spa unit 402 such that a portion of the protective cover portion 106, namely the cap 302, can be accessed from the surface of a wall. For the purposes of FIG. 6. the wall is the surrounding wall 408, however, it should be understood that the wall may be any surface such as the floor 406, the ceiling or any surrounding walls 408 of a structure. In the specific implementation wherein the lighting system 100 is installed within a wall, the illumination member 200 contained within the housing can be accessed by removing the cap 302 from the protective cover portion 106. When the cap 302 is removed, the illumination member 200 can be inserted or withdrawn from the chamber, through the passageway defined by the opening at the end of the elongated body 300 opposite to the end connected to the socket portion 400. Manipulation of the illumination member 200 is facilitated through the use of handle portion 204.

The lighting system 100 may be used in any suitable environment such as, but not limited to:

any light emitting structure such as a lamp or ceiling light;

a vehicle, such as a car, boat, or plane;

a body suitable for containing water such as a spa unit, a pool, a bath tub;

The person skilled in the art will appreciate that when the lighting system 100 is used within a body containing water, the lighting system 100 is adapted for preventing water from reaching the illumination member 200.

Although the present invention has been described in considerable detail with reference to certain preferred embodiments thereof, variations and refinements are possible without departing from the spirit of the invention. Therefore, the scope of the invention should be limited only by the appended claims and their equivalents.

What is claimed is:

1. A lighting system comprising:

a) an illumination member including an electricity conductive portion and a light emitting portion;

b) a housing for being positioned within a wall of a human bathing unit, said housing defining a chamber for receiving therein the illumination member, said housing including a socket portion adapted for engaging said electricity conductive portion;

c) a resilient element suitable for establishing a contact between said illumination member and said housing for biasing said electricity conductive portion against said socket portion.

2. A lighting system as defined in claim 1, wherein said resilient element protrudes from said light emitting portion.

3. A lighting system as defined in claim 2, wherein said resilient element is releasably connected to said light emitting portion.

4. A lighting system as defined in claim 2, wherein said resilient element is permanently affixed to said light emitting portion.

5. A lighting system as defined in claim 2, wherein said resilient element is positioned substantially centrally to said light emitting portion.

6. A lighting system as defined in claim 2, wherein said light emitting portion defines a periphery, said resilient element being positioned substantially about the periphery.

7. A lighting system as defined in claim 1, wherein said housing has an outer surface and an inner surface, said resilient element protruding from said inner surface.

8. A lighting system as defined in claim 7, wherein said resilient element is releasably connected to said inner surface.

9. A lighting system as defined in claim 7, wherein said resilient element is permanently affixed to said inner surface.

10. A lighting system as defined in claim 1, wherein said housing includes a protective cover portion, said protective cover portion being releasably connected to a remaining portion of said housing.

11. A lighting system as defined in claim 10, wherein said protective cover portion includes a translucent member.

12. A lighting system as defined in claim 10, wherein said protective cover portion includes a removable cap.

13. A lighting system as defined in claim 1, wherein said resilient element includes a spring.

14. A lighting system as defined in claim 1, wherein said illumination member includes a handle portion enabling removal of said illumination member from said housing.

15. A lighting system as defined in claim 14, wherein said resilient element is adapted to engage said handle portion.

16. A lighting system as defined in claim 1, wherein said light emitting portion includes a plurality of light emitting diodes (LEDs).

17. A lighting system as defined in claim 1, wherein said resilient element includes a rubber exterior surface for increasing frictional engagement between the resilient element and the housing.

18. A lighting system as defined in claim 1, wherein said resilient element includes a rubber element, the rubber element increasing frictional engagement between the resilient element and the housing.

19. An illumination device for use in a lighting system including a housing having a socket portion, said illumination device comprising:

a) an electricity conductive portion adapted for engaging the socket portion of the housing;

b) a light emitting potion;

c) a resilient element suitable for establishing a contact with the housing of the lighting system for biasing said electricity conductive portion against the socket portion of the housing wherein said resilient element includes a rubber element for increasing frictional engagement between the resilient element and the housing; and d) a handle portion for enabling removal of said electricity conductive portion at said illumination device from the socket of the housing.

20. An illumination device as defined in claim 19, wherein said resilient element protrudes from said light emitting portion.

21. An illumination device as defined in claim 20, wherein said resilient element is releasably connected to said light emitting portion.

22. An illumination device as defined in claim 20, wherein said resilient element is permanently affixed to said light emitting portion.

23. An illumination device as defined in claim 20, wherein said resilient element is positioned substantially centrally to said light emitting portion.

24. An illumination device as defined in claim 20, wherein said light emitting portion defines a periphery, said resilient element being positioned substantially about the periphery.

25. An illumination device as defined in claim 19, wherein said resilient element includes a spring.

26. An illumination device as defined in claim 19, wherein said resilient element is adapted to engage said handle portion.

27. An illumination device as defined in claim 19, wherein said light emitting portion includes a plurality of light emitting diodes (LEDs).

28. An illumination device suitable for use in a lighting system including a housing having a socket portion, said illumination device comprising:

a) an electricity conductive portion adapted for engaging the socket portion of the housing;

b) a light emitting portion;

c) a resilient element suitable for establishing a contact with the housing of the portion of the housing wherein said resilient element includes a rubber exterior surface for increasing frictional engagement between the resilient element and the housing; and d) a handle portion for enabling removal of said electricity conductive portion of said illumination device from the socket of the housing.

29. A lighting system comprising:

a) illumination means including an electricity conductive means and a light emitting means;

b) housing means for being positioned within a wall of a human bathing unit, said housing means defining a chamber for receiving therein the illumination means, said housing means including means for engaging said electricity conductive means;

c) resilient means suitable for establishing a contact between said illumination means and said housing means for biasing said electricity conductive means against said means for engaging said electricity conductive means.

30. A lighting system comprising:

a) illumination means including a handle means and a light emitting means, wherein said handle means protrudes from said light emitting means;

b) housing means for being positioned within a wall of a human bathing unit, said housing means including:

i) light receiving means defining:

(1) a chamber for receiving said illumination means therein; and (2) a passageway to said chamber;

ii) sealing means adapted for being removably connected to said light receiving means for sealing said passageway;

wherein the handle means of said illumination means enables removal of said illumination means from said chamber through said passageway.

31. A housing suitable for use in a lighting system, said housing comprising:

a) a light receiving portion for being positioned within a wall of a human bathing unit, said light receiving portion defining a chamber for receiving an illumination member therein, the illumination member having an electricity conductive portion;

b) a socket portion adapted for engaging the electricity conductive portion of the illumination member;

c) a resilient element suitable for establishing a contact between the illumination member positioned within said housing and said housing for biasing the electricity conductive portion of the illumination member against said socket portion.

32. A housing as defined in claim 31 wherein said housing includes a protective cover portion and a receptacle portion, said protective cover portion being releasably connected to the receptacle portion of said housing.

33. A housing as defined in claim 32, wherein said protective cover portion has an outer surface and an inner surface, said resilient element protruding from said inner surface.

34. A housing as defined in claim 33, wherein said resilient element is releasably connected to said inner surface.

35. A housing as defined in claim 33, wherein said resilient element is permanently affixed to said inner surface.

36. A housing as defined in claim 32, wherein said protective cover portion includes a removable cap.

37. A housing as defined in claim 32, wherein said protective cover portion includes a translucent member.

38. A housing as defined in claim 31, wherein said resilient element includes a spring.

39. A housing as defined in claim 31, wherein said resilient element includes a rubber exterior surface for increasing frictional engagement between the resilient element and said housing.

40. An illumination device suitable for use in a lighting system including a housing, the housing having a socket portion, said illumination device comprising:

a) electricity conductive means for engaging the socket portion of the housing;

b) light emitting means;

a) resilient means for establishing a contact with the housing of the lighting system for biasing said electricity conductive means against the socket portion of the housing wherein said resilient means includes a rubber element means for increasing frictional engagement between the resilient means and the housing;

d) handle means for enabling removal of said electricity conductive means from the socket portion of the housing.

41. A lighting system comprising:

a) an illumination member including a handle portion and a light emitting portion, wherein said handle portion protrudes from said light emitting portion;

b) a housing for being positioned within a wall of a human bathing unit, said housing having:

i) a light receiving portion defining;

(1) a chamber for receiving said illumination member therein; and (2) a passageway to said chamber;

ii) a cap adapted for being removably connected to said light receiving portion for sealing said passageway;

wherein the handle portion of said illumination member enables removal of said illumination member from said chamber through said passageway.

42. A lighting system as defined in claim 41, wherein said handle portion is permanently affixed to said light emitting portion.

43. A lighting system as defined in claim 41, wherein said handle portion is positioned substantially centrally to said light emitting portion.

44. A lighting system as defined in claim 41, wherein said light emitting portion defines a periphery, said handle portion being positioned substantially about the periphery.

45. A lighting system as defined in claim 41, wherein said cap includes a translucent member.

46. A lighting system as defined in claim 41, wherein said light emitting portion includes a plurality of light emitting diodes (LEDs).

47. A lighting system as defined in claim 41, wherein said cap can be accessed from a surface of said wall.

48. A lighting system as defined in claim 47, wherein the wall is selected from the set consisting of a floor and a surrounding wall.

49. A lighting system as defined in claim 48, wherein the wall is part of a spa unit.

50. An illumination device suitable for use in a lighting system including housing having a socket portion, said illumination device comprising;

a) an electricity conductive portion adapted for engaging the socket portion of the housing;

b) a light emitting portion including:

i) a surface generally opposed to said electricity conductive portion;

ii) a plurality of light emitting diodes (LEDs) extending from said surface, c) a handle portion extending from the surface of said light emitting portion, the handle portion enabling removal of said electricity conductive portion of said illumination device from the socket of the housing;

d) a resilient element suitable for establishing a contact with the housing of the lighting system for biasing said electricity conductive portion against the socket portion of the housing.

* * * * *

UNITED STATES PATENT AND TRADEMARK OFFICE

CERTIFICATE OF CORRECTION

PATENT NO. : 6,942,354 B2
DATED : September 13, 2005
INVENTOR(S) : Francois Metayer et al.

It is certified that error appears in the above-identified patent and that said Letters Patent is hereby corrected as shown below:

Title page, Item [54] and Column 1, line 1,
Title, replace "THEREFORE" by -- THEREFOR --.

Signed and Sealed this

Twentieth Day of December, 2005

JON W. DUDAS
*Director of the United States Patent and Trademark Office*